US005510057A

United States Patent [19]

Riggs

[11] Patent Number: 5,510,057

[45] **Date of Patent: *Apr. 23, 1996**

[54] CORROSION INHIBITING METHOD AND INHIBITION COMPOSITIONS

[76] Inventor: Olen L. Riggs, P.O. Box 968, Bethany, Okla. 73008

[ * ] Notice: The portion fo the term of this patent shall not extend beyond the expiration date of Pat. No.5,202,058.

[21] Appl. No.: 232,282

[22] PCT Filed: Nov. 5, 1992

[86] PCT No.: PCT/US92/09511

§ 371 Date: May 6, 1994

§ 102(e) Date: May 6, 1994

[87] PCT Pub. No.: WO93/09268

PCT Pub. Date: May 13, 1993

[51] Int. Cl.[6] ..... C23F 11/10; C23F 11/14

[52] U.S. Cl. ..... 252/387; 252/394; 252/389.1; 422/16; 422/19

[58] Field of Search ..... 422/19, 16; 252/387, 252/389.1, 68, 71, 75, 396, 394

[56] References Cited

U.S. PATENT DOCUMENTS

| | | | |
|---|---|---|---|
| 3,679,579 | 7/1972 | Preusser et al. | 585/808 |
| 3,776,835 | 12/1973 | Dvoracek | 208/48 AA |
| 4,124,512 | 11/1978 | Stournas et al. | 507/244 |
| 4,284,517 | 8/1981 | Chen et al. | 507/231 |
| 4,440,625 | 4/1984 | Go et al. | 208/48 AA |
| 4,619,756 | 10/1986 | Dickakian | 208/48 AA |
| 4,913,830 | 4/1990 | Lundberg | 252/49.6 |
| 4,937,007 | 6/1990 | Damin et al. | 507/90 |
| 5,104,518 | 4/1992 | Jäger | 208/125 |
| 5,139,643 | 8/1992 | Roling et al. | 208/48 AA |
| 5,171,420 | 12/1992 | Forester | 208/48 AA |
| 5,171,421 | 12/1992 | Forester | 208/48 AA |
| 5,183,555 | 2/1993 | Forester | 208/48 AA |
| 5,194,142 | 3/1993 | Forester | 208/48 AA |
| 5,194,620 | 3/1993 | Roling et al. | 548/112 |
| 5,202,058 | 4/1993 | Riggs, Jr. | 252/387 |
| 5,211,834 | 5/1993 | Forester | 208/48 AA |
| 5,211,835 | 5/1993 | Forester | 208/48 AA |
| 5,292,425 | 3/1994 | Forester | 208/48 AA |
| 5,342,505 | 8/1994 | Forester | 208/48 AA |

*Primary Examiner*—Gary Geist
*Assistant Examiner*—Valerie Fee
*Attorney, Agent, or Firm*—Harold D. Messner

[57] ABSTRACT

The present invention provides a method and compositions useful for inhibiting corrosion of a corrodible metal resulting from contact of water and air with the metal. In this method, a stannous salt and a hydrocarbyl substituted succinimide of a polyethylene polyamine are added to the water in minor amounts and cooperatively reduce corrosion of the metal to a substantially zero rate. While the amount of each agent for an effective inhibition is minor, say in the range of from about 0.1 to 100 ppm, a relatively concentrated solution is required for addition to the water. Suitable solvent media include the lower alkanols and mixture thereof with or without added water. Isopropanol is preferred. The solvent component of the compositions also varies depending upon the particular imide and/or salt component employed and the concentration desired. In general, the lower alkanol portion of the medium is in the range of from about 15 to 100 volume percent and the water portion is in the range of from about 0 to 85 volume percent. A medium in the range of from about 50 to 67 volume percent water is preferred. The relative amounts of the imide and/or stannous salt components desirably used varies depending upon the nature of the cooling water in which the agents are employed. Satisfactory relative amounts by weight for each to the other at set forth above, are in the range of from about 0.5 to 10, preferably 0.8 to 2 and more preferable about 1 to 1 weight ratio.

17 Claims, No Drawings

CORROSION INHIBITING METHOD AND INHIBITION COMPOSITIONS

This application is a 371 of PCT/US92/09511, filed Nov. 5, 1992, now Publication No. WO/93/09268.

SCOPE OF THE INVENTION

The present invention relates to a method for inhibiting corrosion of corrodible ferrous metal in a water-metal-air contact system by means of a dual corrosion agent system and compositions for the practice of the method.

BACKGROUND OF THE INVENTION

Cooling water tower systems are usually fabricated of ferrous metal. A common problem is severe corrosion which results from water and air contact with the metal, especially in the case where the cooling water is brackish.

Chromate type inhibitors formerly used to reduce corrosion have been banned for use because of environmental impact problems. Consequently, there is a need for a new effective corrosion inhibitor system and, of course, for one which exhibits improved efficiency inhibiting corrosion and which employs materials free of deleterious environmental impact effects.

Inhibitors currently available to the art, for example, phosphate, phosphonate, molybdate, nitrite and zinc types and the like reduce carbon steel corrosion rates in brackish water to an amount on the order of 16 to 35 mills per year (mpy). This is a series rate and one hardly acceptable considering replacement and repair costs for cooling towers.

SUMMARY OF THE INVENTION

The present invention provides a method and compositions useful for inhibiting corrosion of ferrous metal resulting from contact of water and air with the metal. In this method, a stannous salt and a hydrocarbyl substituted succinimide of a polyethylene polyamine are added to the water in minor amounts and cooperatively reduce corrosion of the metal to a substantially zero rate. While the amount of each agent for an effective inhibition is minor, say in the range of from about 0.1 to 100 ppm, a relatively concentrated solution is required for addition to the water. Suitable solvent media include the lower alkanols and mixture thereof with or without added water. Isopropanol is preferred. The solvent component of the compositions varies depending upon the particular imide and/or salt component employed and the concentration desired. In general, the lower alkanol portion of the medium is in the range of from about 15 to 100 volume percent and the water portion is in the range of from about 0 to 85 volume percent. A medium in the range of from about 50 to 67 volume percent water is preferred. The relative amounts of the imide and stannous salt components desirably used varies depending upon the nature of the water in which the agents are employed. Satisfactory relative amounts by weight for each to the other at set forth above, are in the range of from about 0.5 to 10, preferably 0.8 to 2 and more preferably about 1 to 1 weight ratio.

DETAILED DESCRIPTION OF THE INVENTION

The present invention is based upon novel corrosion inhibitor compositions and their cooperative use in a method wherein corrosion of corrodible ferrous metals, e.g., low carbon, silica and mild steels and the like, is reduced to a negligible rate.

The corrosion inhibiting agents required for the practice of the present invention must disperse readily in water, especially brackish water. While the amount of each of the agents required for an effective inhibition is minor, e.g., in the range of from about 0.1 to 100 ppm, preferably 0.5 to 10 ppm, a relatively concentrated solution is required before the solution is added to the water. Suitable solvent media include the lower alkanols, e.g. methanol, ethanol, propanol, isopropanol and mixtures thereof with or without added water. Isopropanol is preferred.

The solvent or medium component of the compositions varies depending upon the particular imide and/or salt component employed and the concentration desired. In general, the lower alkanol portion of the medium is in the range of from about 15 to 100 volume percent and the water portion is in the range of from about 0 to 85 volume percent. A medium in the range of from about 50 to 67 volume percent water is preferred.

The relative amounts of the imide and stannous salt components desirably used varies depending upon the condition of the industrial water in which the compositions of the invention are to be used. Satisfactory relative amounts by weight for each to the other as set forth above, are in a range of from about 0.5 to 10, preferably 0.8 to 2 and still more preferably about a 1 to 1 weight ratio.

In addition to a suitable medium for the agents and to enhance dispersion of the agents into water, the concentrates herein require an effective amount of a suitable wetting agent. An effective amount of a wetting agent is in the range of from about 0.1 to 5, preferably 0.3 to 1, weight percent of the inhibitor agent. In general, the use of an amount of wetting agent in excess of about 5 weight percent is neither deleterious nor enhancing, but is, of course, not cost effective. Particular and preferred wetting agents for use in the compositions herein described, are the polysorbate surfactants and mixtures thereof, preferably mono-9-octadeceneoatc poly(oxy-1,2-ethanediyl) groups. The sorbitol surfactants effectively dispenses the inhibitors of the invention are also are believed to enhance corrosion prevention. Thus, in the absence of these surfactants less effective corrosion inhibition is experienced, and where a non-sorbitol type surfactant has been used, markedly inferior corrosion inhibition has been experienced. The sorbitol surfactants used herein are known and prepared conventionally as known in the art, e.g., by the reaction of ethylene oxide with the mon-ester or 9-octadeceneoic acid and sorbitol.

Stannous salts having an appreciable (at least 0.1 weight percent) solubility in water, in general, are suitable for use in the present invention. Representative stannous salts suitable for use, include the chloride and its dihydrate acetate, butyrate, octanate, isobutyrate, hexadecanoate, and the like salts. The chlorides are a preferred group. Most preferred are the salts of organic mono-carboxylic acids having a carbon atom content in the range of from about 1 to 16, preferably 4 to 10 carbon atoms.

EXAMPLE I

A solution of stannous chloride was prepared by heating and stirring a mixture of ethanol and the dihydrate of stannous chloride to about 65 degrees C. and then adding mono-9-octadaceneoate poly (oxy-1, 2-ethanediyl) sorbitol (about 20 ethanediyl groups) surfactant (1% by weight of the ethanol-stannous chloride mixture). additional ethanol was added to obtain about a 20 weight percent solution of stannous chloride.

SUCCINIMIDES

Succinimides of polyethylene polyamines are in general satisfactory for use in the invention. Preferred imides are those obtained from substituted succinic acids or acid anhydrides known in the art in which the substitutent is a hydrocarbyl group having a carbon atom content in the range of from 1 to about 15, more preferably is an aliphatic hydrocarbon group and most preferably is an alkenyl group having a carbon atom content in the range of 3 to about 15. Representative alkenyl groups include n- and iso-octenyl, pentenyl, dodecenyl and the like, alkenyl groups. These substituted succinic acids or anhydrides are know and are prepared by conventional reactions, e.g., by the free radical catalyzed addition of alpha-olefines to maleic acid and its anhydride.

The polyethylene polyamine component of the imides satisfactory for use in the invention, contain from 1 to about 8 ethylene groups and from 2 to about 9 amino groups. Representative polyamines include ethylene diamine, diethylene triamine, triethylene tetramine, tetraethylene pentamine, pentaethylene hexamine, mixtures thereof, unfractionated e.g., crude preparative reaction product mixtures thereof and the like, polyethylene polyamines. Tetraethylene pentamine is preferred. The polyamines are known and prepared by conventional reactions known in the art.

EXAMPLE II

N-octenyl succinimide of tetraethylene pentamine was prepared by placing one mole of the amine in a reaction flask fitted with an additional funnel containing one mole of n-octenyl succinic anhydride, a water collector, a stirring the amine, the anhydride in the funnel was slowly added to the flask. Upon completion of the addition, the resulting reaction mixture was heated to about 142 degrees C. where water of reaction started to distill over. At about 180 degrees C., the resulting reaction product, viz., n-octenyl succinimide of tetraethylene pentamine, was a clear bright orange liquid. About one mole of water was collected in the collector signifying that the imide-forming reaction was complete. The flask and its contents were then cooled to about 80 degrees C. and sufficient isopropanol and distilled water were added to yield a solution which was: (i) 40 volume percent isopropanol, (ii) about 60 volume percent water and (iii) about 30 weight percent imide. Into this solution, based upon the total weight of the solution, about 1 weight percent mono-9-octadeceneoate of poly (oxy-1, 2-ethanedlyl) sorbitol (about 20 ethanediyl groups) surfactant was added to facilitate effective dispersion of the imide agent when added to cooling water. The flask and its contents were maintained at about 80 degrees C. with stirring until a clear solution resulted. The cooled solution was ready for use in accordance with the invention.

The relative amounts of the imide and/or salt inhibitor components required for the compositions of the invention varies depending upon the solvent medium and practicality. Thus, as the composition is diluted further and further, larger and larger amounts of the inhibitor solution must be added to the cooling water in order to achieve an effective concentration. As a practical matter, the inhibitor component must be at least 5 weight percent of the solution and is usually in the range of from about 5 weight percent to about the saturated solution value. The preferred range is from about 20 to 40 weight percent, particularly about 30 weight percent.

The inhibitors of the invention are introduced into the water of the metal-water-air contact system using usual, conventionally known procedures, as practiced in the art. Thus, the inhibitor solution or solutions are stored in an attendant storage tank and are pump-metered into the water to be treated. The initial dosage may be larger than those later metered in that is, excess inhibitor is introduced initially. Means are dynamically monitor the treatment process including monitoring the corrosion rate of a test sample placed in the system, chemical analysis of treated water samples, etc. Make-up water, of course, includes added inhibitor.

EXAMPLE III the procedure of EXAMPLE 1, supra, was repeated except that stannous octanoate was used in place of stannous chloride. The resulting solution was especially advantageous because in admixture with the imide solution of EXAMPLE II, supra, a stable solution resulted. This was in contrast wherein on standing, mixtures of the salt solution of EXAMPLE I with the imide solution of EXAMPLE II clouded up and some precipitation resulted. While the solutions of EXAMPLES I and II are desirably separately added to the water to be treated, note that they need not be where shelf life of the combined components is minimal. But the stannous organic carboxylate salt-imide solutions of EXAMPLE III always require but a single inlet irrespective of shelf life of the solution and provide corrosion inhibition effects as treatment of the water occurs at least as good as where separate additions of the salt and imide solutions of EXAMPLES I and II are made.

CORROSION TEST CONDITIONS

Corrosion tests were made using 1"×2"×⅛" carbon steel test coupons which were immersed and suspended in filtered brackish water (see TABLE I for analysis thereof) constrained in 1-liter glass flasks. The flasks were fitted with reflux condensers as well as means for bubbling air (at a rate of about 1.5 cubic feet per hour) through the flasks and contents thereof. A constant temperature of 65 degrees C. was maintained by immersing the flasks in a constant temperature water bath. The test were of seven (7) days duration. The results are listed in TABLE II.

TABLE I

A TYPICAL BRACKISH WATER USED IN A UTILITY COOLING TOWER

| ANALYSIS | BRACKISH MAKE-UP, PPM UNLESS OTHERWISE NOTED | TOWER, PPM UNLESS OTHERWISE NOTED |
|---|---|---|
| pH | 9.2 | 9.4 |
| CONDUCTIVITY | 17,200 | 35,000 |
| TDS, MG/L | 8,650 | 18,340 |
| TSS, MG/L | 2.4 | 5 |
| ORGANIC TOTAL, " | 15 | 31 |
| NITROGEN | 0.01 | 0.01 |
| NITRATE | 5 | 18 |
| CHLORIDE | 13,000 | 64,000 |
| CARBONATE | 94 | 182 |
| BICARBONATE | 480 | 860 |
| SULFATE | 1,310 | 2,700 |
| PHOSPHATE | 2.8 | 8 |
| SODIUM | 5,710 | 13,000 |
| CALCIUM | 12 | 25 |
| MAGNESIUM | 3 | 5.2 |
| IRON | 0.6 | 1.3 |
| SILICON | 73 | 170 |
| POTASSIUM | 41 | 92 |
| BARIUM | 0.3 | 0.6 |

TABLE I-continued

A TYPICAL BRACKISH WATER USED IN A UTILITY COOLING TOWER

| ANALYSIS | BRACKISH MAKE-UP, PPM UNLESS OTHERWISE NOTED | TOWER, PPM UNLESS OTHERWISE NOTED |
|---|---|---|
| "P" ALKALINITY | 355 | 844 |
| "M" ALKALINITY | 1,660 | 3,400 |

NOTE:
"P" ALKALINITY: The alkalinity above a pH of about 8.2
"M" ALKALINITY: The alkalinity between a pH of 4.3 & 8.2
TDS: Total Dissolved Solids
TSS: Total Suspended Solids

TABLE II

TEST RESULTS

| TEST NO | INHIBITOR (25 PPM) | RATE, PPM | CORROSION SURFACE CONDITION |
|---|---|---|---|
| 1. | SnCL2 | 0.86 | SMALL PIN PT. OXIDATION |
| 2. | A | 8.17 | WET OXIDATION, FILIFORM |
| 3. | SnCL2 & A | 2.48 | SMALL AREA OF OXIDATION |
| 4. | N-OCTENYL SUCCINIC ACID | 26.34 | LOTS OF OXIDATION, FILIFORM |
| 5. | B | 0.20 | ONE TINY SPOT @ HANGER PT. |
| 6. | C | 0.30 | ONE TINY SPOT @ HANGER PT. |
| 7–10. | B + C | 0.07 | NO VISIBLE CORROSION |
| 11. | MOLYBDATE TYPE | 18.20 | SEVERE WET OXIDATION |
| 12. | ZINC & PHOSPHATE TYPE | 18.3 | SEVERE WET OXIDATION |
| 13. | ZINC & PHOSPHONATE TYPE | 8.7 | WET OXIDATION |
| 14. | NONE | 45.1 | SEVERE METAL WASTAGE |

NOTE:
A: N-ACTENYL SUCCIMIDE OF ALLYL AMINE
B: SnCL2 + SORBITOL SURFACTANT AS IN EXAMPLE I
C: N-OCTENYL SUCCINIMIDE AS IN EXAMPLE 11

The data of TABLE II, supra, demonstrate that individually the stannous chloride and succinimide compositions herein are effective corrosion inhibitors for corrodible ferrous metal. It further demonstrates that the compositions of the invention acting in consort provide a corrosion system which is markedly superior to corrosion systems known and used in the prior art. These data further establish that the method of the invention provides effective protection for corrodible ferrous metals subject to the corrosive effects of water and air, especially of brackish water and air.

The foregoing is considered as illustrative only of the principles of the invention. Further, numerous modifications and changes can readily occur. For example, while the invention has been described in connection with corrosion protection of corrodible ferrous metal, other types of metals, such as copper and aluminum can also be protected by the principles of the invention. Therefore, it is to be understood that within the scope of the appended claims, the invention may be practiced other than as specifically described.

Additional Examples

EXAMPLE IV

A corrosion inhibitor blend was prepared by stirring a mixture of isopropanol and stannous octoate with tolyltriazole and polyoxyethylated monooleate sorbital as follows:

| CHEMICAL | PERCENT BY WEIGHT |
|---|---|
| Stannous Octoate | 25 |
| Tolyltriazole | 25 |
| Polyoxyethylated Monooleate Sorbitol | 3 |
| Isopropanol | 47 |

These chemical concentrations can vary within a given inhibitor blend as follows: for stannous octoate from about 5 percent by weight to 50 percent by weight; for tolyltriazole from about 3 percent by weight to 30 percent by weight; for polyoxyethylated monooleate sorbitol from about 0.5 percent by weight to 5 percent by weight; for isopropanol 15 percent by weight to about 91.5 percent by weight. The tolyltriazole aids in providing at least two effects of an unobvious nature as a constituent of the solvent medium of the invention: inhibiting corrosion of copper within the cooling water system as well as controlling solubility so that the invention, when added to the cooling water, has substantial solubility and dispersability.

EXAMPLE V

A blend of tolyltriazole, stannous octoate, n-alkenyl succinic anhydride, and polyoxyethylated monooleate sorbitol in 2-butoxyethanol was prepared as an industrial cooling water corrosion inhibitor. The concentrations were are follows:

| CHEMICAL | PERCENT BY WEIGHT |
|---|---|
| Tolyltriazole | 20 |
| n-Alkenyl Succinic Anhydride | 10 |
| Stannous Octoate | 12 |
| Polyoxyethylated Monooleate Sorbitol | 3 |
| 2-Butoxyethanol | 55 |

Variation in the above concentrations can be as follows: tolyltriazole can vary from 3 percent by weight to about 25 percent by weight, for n-alkenyl succinic anhydride from 5 percent by weight to 20 percent by weight; for stannous octoate from 0.5 percent by weight to 20 percent by weight; for polyoxyethylated monooleate sorbitol from 0.5 percent by weight to 5 percent by weight and for 2-butoxyethanol from 30 percent by weight to about 86.5 percent by weight. Note that the tolyltriazole and n-alkenyl succinic anhydride are not reacted together but are blended along with the 2-butoxyethanol to form an improved solvent medium of the composition of the invention. In addition to the improved characteristics noted with regard to Example IV due to the two fist-listed constituents, the solvent medium of Example V also had improved flash point characteristics owing to the last-listed constituent that permits usage of the invention in and about plant locations where fire ignition is a hazard.

EXAMPLE VI

This blend was prepared and used in concert with the blends of Example IV and V, above. It is second solvent medium containing 1-hydroxyethylidene-1, 1-diphosphonic acid treated with potassium hydroxide to a ph of 12 and a carboxylate/sulfonate/nonionic functional terpolymer (Tradename: "Acumer 3100", Rohn and Haas) treated with potassium hydroxide to a ph of 8. The blend was then dissolved in water as follows:

| CHEMICAL | PERCENT BY WEIGHT |
|---|---|
| 1-hydroxyethylidene-1, 1-diphosphonic acid | 15 |
| Acumer 3100 | 15 |
| Distilled water | 70 |

Variation in concentration can be as follows: for 1-hydroxyethylidene-1, 1-diphosphonic acid from 5 percent by weight to 30 percent by weight; for Acumer 3100 from 3 percent by weight to about 50 percent by weight; and for distilled water from 20 percent by weight to about 92 percent by weight. This blend also has several unobvious effects as a component of the solvent medium of the invention, inter alia: it conditions the cooling water by increasing dispersability and inhibiting scale formation. While this blend can be added to Examples IV and V before the later are dispersed in the cooling water, the preferred mode is to first add the blend of Example VI to the cooling water followed by the addition of Example IV or V. The results in Table III were derived using the last-mentioned technique.

TABLE III

| CORROSION TEST | | | |
|---|---|---|---|
| TEST | | CORROSION | |
| NO. | INHIBITOR | RATE MPY | SURFACE |
| 15 | Example IV + Example VI | 0.000 | No corrosion |
| 16 | Example V + Example VI | 0.000 | No corrosion |

Note:
For test 15 and 16, the concentration of Example VI was 25 ppm concentration as was Examples IV and V, respectively.

What is claimed is:

1. A corrosion inhibiting cooling water composition consisting essentially of a stannous salt for use in cooling water in a minor amount of at least 0.1 parts per million parts thereof, a solvent medium containing a first solvent medium and a second solvent medium, and a polysorbate surfactant wherein (1) said amount of said stannous salt is in the range of from 5 weight percent of said medium to the saturation value of said solvent salt in said solvent medium, (2) said solvent medium has a lower alkanol content in the range of from about 15 to 100 volume percent and a water content in the range up to 85 volume percent.

2. The composition of claim 1 wherein said at least 0.1 parts per million parts of cooling water, further contains a hydrocarbyl substituted succinimide of a polyethylene polyamine acting in concert with said stannous salt to cooperatively inhibit a corrodible metal from attack in said cooling water.

3. The composition of claim 2 wherein said stannous salt and said hydrocarbyl substituted succinimide of a polyethylene polyamine are each from about 0.5 to 100 parts per million parts of said cooling water.

4. The composition of claim 1 wherein said amount of said salt in said first solvent medium is in the range of from about 20 to 40 weight percent of said first solvent medium.

5. The composition of claim 4 wherein said amount of said salt in said first solvent medium is about 30 weight percent of said first solvent medium.

6. The composition of claim 1 wherein said surfactant is mono-9-octadenceneoate poly (oxy-1, 2-ethanedlyl) sorbitol containing in the range of from about 8 to 50 (oxy-1, 2-ethanediyl) groups.

7. The composition of claim 6 wherein said mono-9-octadeceneoate poly (oxy-1, 2-othanediyl) sorbitol contains in the range of from about 15 to 25 (1, 2-ethanediyl) groups.

8. The composition of claim 1 wherein said salt is selected from the group consisting of stannous chloride and stannous salts of aliphatic mono-carboxylic acids having a carbon atom content in the range of from about 1 to 16 and said water content of said first solvent medium is in the range up to 85 volume percent and said amount of surfactant is in the range of from about 0.1 to 5 weight percent of said composition.

9. The composition of claim 8 in which said alkanol content of said first solvent medium is in the range of from about 50 to 90 weight percent.

10. The composition of claim 8 in which said amount of surfactant is in the range of from about 0.3 to 25 weight percent of said stannous salt.

11. The composition of claim 9 wherein said the first solvent medium said alkonal is isopropanol and where said first solvent medium further contains tolyltriazole is in the range from about 3 to 30 weight percent of said composition.

12. The composition of claim 11 in which said isopropanol is in the range from 15 to 91.5 weight percent of said composition.

13. The composition of claim 12 wherein the second solvent medium is composed of 1-hydroxyethylidene, 1-diphosphonic acid, a carboxylate/sulfonate/nonionic functional terpolymer, potassium hydroxide, and distilled water.

14. The composition of claim 9 wherein said in second solvent medium is a blend of tolyltriazole, n-alkenyl succinic anhydride and 2-1-butoxyethanol where said tolyltriazole is in the range from 3 to 25 weight percent of said composition.

15. The composition of claim 14 in which said n-alkenyl succinic anhydride is in the range of 5 to 20 weight percent of said composition.

16. The composition of claim 15 in which said 2-butoxyethanol is in the range from 30 to 66.5 weight percent of said composition.

17. The composition of claim 16 wherein the second solvent medium is composed of 1-hydroxyethylidene, 1-diphosphonic acid, a carboxylate/sulfonate/nonionic functional terpolymer, potassium hydroxide, and distilled water.

* * * * *